United States Patent [19]

Tomé

[11] 4,367,379

[45] Jan. 4, 1983

[54] MULTIPLE SELECTIVE SWITCH

[75] Inventor: Eduardo S. Tomé, Madrid, Spain

[73] Assignee: Disyuntor-Regulador A.S.D.,S.A., Madrid, Spain

[21] Appl. No.: 163,526

[22] Filed: Jun. 27, 1980

[30] Foreign Application Priority Data

Jun. 28, 1979 [ES] Spain ..... 244237

[51] Int. Cl.[3] ..... H01H 15/02; H01H 3/00; H01H 9/26

[52] U.S. Cl. ..... 200/5 R; 200/16 R; 200/153 LA

[58] Field of Search ..... 200/1 R, 1 A, 16 R, 200/18.5 R, 61.86, 153 L, 153 LA

[56] References Cited

U.S. PATENT DOCUMENTS

| | | | |
|---|---|---|---|
| 3,047,682 | 7/1962 | Hults | 200/153 LA |
| 3,223,794 | 12/1965 | Hoy et al. | 200/16 C |
| 3,906,178 | 9/1975 | Fiddler et al. | 200/61.86 |
| 4,114,000 | 9/1978 | Feder | 200/153 LA X |

*Primary Examiner*—James R. Scott
*Attorney, Agent, or Firm*—Fleit & Jacobson

[57] ABSTRACT

Multiple-circuit switch with selective operation, especially applicable to automotive vehicles, consisting of a chassis with a dentate configuration on its upper part, inside of which is housed a pin-bearing part and above it a cam-bearing part, and above the latter another part having a cross-section in the shape of a crown with a dentate configuration on its upper part linked to an operating lever ending in a fork so that the angular movements of the lever bring about longitudinal movements of the cam-bearing part and with it the crown part. There are contacts between the dentate surfaces which will bring about successive retentions of the movements, pushing downward the cam-bearing part in a successive and selective fashion, resulting in downward motion of some pins inserted in the pin-bearing part, the pins acting on contact plates in order to activate distinct associated circuits.

5 Claims, 4 Drawing Figures

MULTIPLE SELECTIVE SWITCH

BACKGROUND OF THE INVENTION

1. Field of Invention

The subject matter of the present application refers to a multiple switch by means of which, with a single control, multiple circuits can be opened or closed, and which furthermore is of selective operation in that with said control, the circuits to be opened or closed can be determined.

In particular, this multiple switch is designed to be applied in the automotive field, wherein there is frequently a need for a distinct operation or degree of operation for some of the services proper to an automotive vehicle, as for example electric brakes, lights, windshield washer, etc.

2. Description of Prior Art

In said field, such devices must fulfill a series of needs such as reduced size, a marking or differentiation of the distinct positions to be adopted, and reliability of use through thousands of operations.

In terms of functions, its immediate antecedent is found in the rock-lever switches with two or more positions, and which normally never exceed three operating positions, including switch-off. Also on the market there are multiple switches based on cams or a labyrinth of lobes and recesses arranged on a circular part moved with the control or operating lever.

SUMMARY OF INVENTION

The multiple switch which is the subject of the invention has the advantage over the former of being able to adopt more than three positions, with more reliable operation deriving from greater simplicity of construction. Moreover, even though it also utilizes cams, it has the advantages over the latter of reduced size, greater simplicity of construction and operation, and smoother operation of the control lever for less travel or movement.

Essentially, the invention comprises an operating lever, ending in a fork and pivoting on a support or chassis having on its upper part a central bridge with a dentate surface on its underside, so as to define or provide for as many operating positions as may be desired. In contact with the dentated upper part, and guided by the fork of the lever, there is a part with an upper surface also dentate, the latter part being pulled into contact with the lower face of the bridge by means of a spring. Moreover, the latter part, in its movement, draws another cam-bearing part which, during said movement, successively and selectively pushes some pins, making them descend. The pins are supported on a clip of contact plates, so that the contact plates flex until they touch terminals arranged in front of them, thus closing distinct circuits connected to the terminals, also in a selective and successive fashion.

According to these characteristics, the multiple switch is made of a plastic material having good antifriction properties, except, of course, on the connection terminals and the spring which keeps the dentate part in contact with the bridge, which is also dentate on its underside. Furthermore, all parts interrelated, and joined to or retained by one another, so that the device has no welds or screws, whereby rapid and simple assembly is achieved. The surfaces in contact for determining the various positions of the switch are of a relatively major size, and of a single material having selflubricating properties, which means that the minimum weardown which they experience will be homogeneous for both surfaces, and the pushing of one against the other will be compensated for, thus giving long life to the switch components.

Furthermore, the thrust pins for the contact plate clip are permanently supported on plates, and their position is such that they must be in a position of contact or opening for the plates, thereby avoiding intermediate or insufficient contact situations producing sparks and shortening of the life of these contacts.

BRIEF DESCRIPTION OF DRAWINGS

In order to make the foregoing more comprehensible, while at the same time pointing out other characteristics and advantages of the subject invention, the following is a more detailed description of a practical realization thereof, accompanied by references to the accompanying drawings representing a mere example, in which.

DETAILED DESCRIPTION

Figure 1:
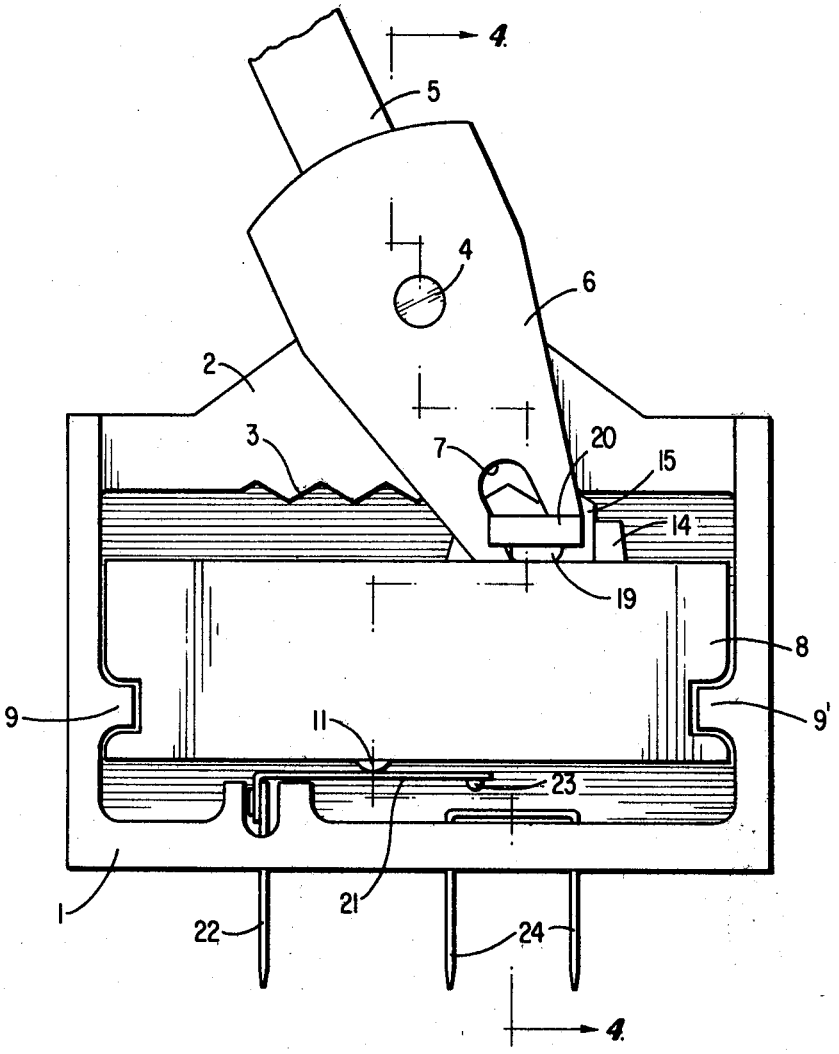
FIG. 1 is an elevation view of the multiple switch of the invention.
Figure 2:
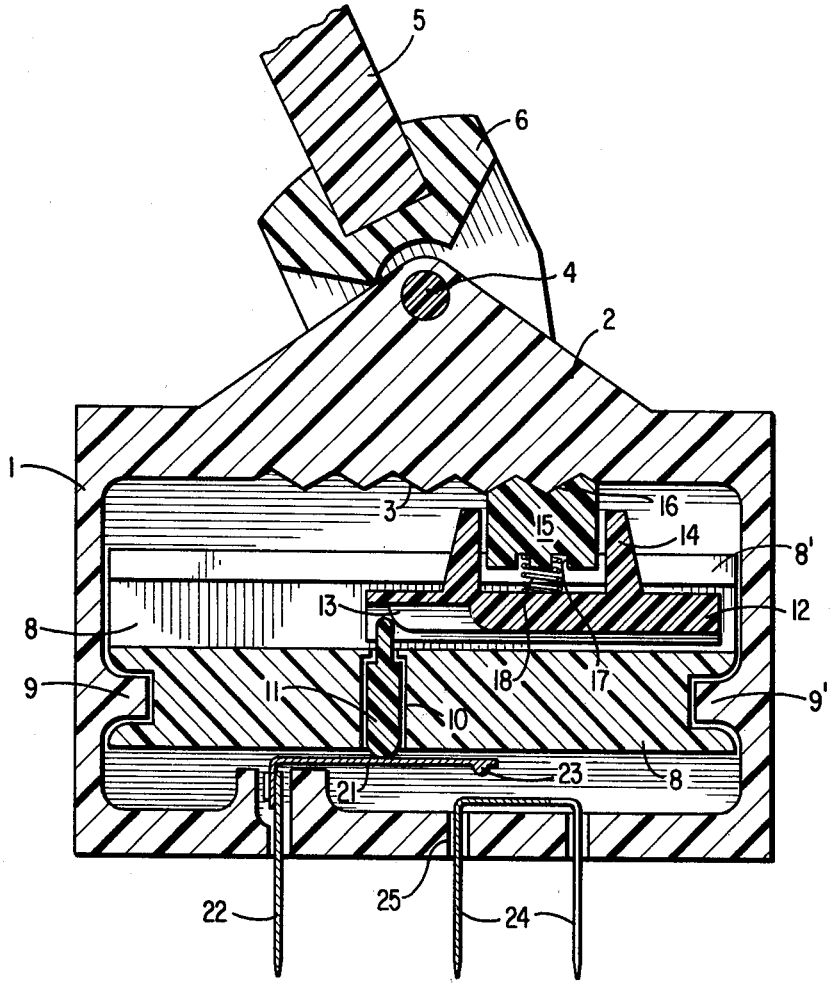
FIGS. 2 and 3 are cross-section views along a median vertical plane of the multiple switch in the connect and disconnect positions, respectively.

The switch comprises a support part or chassis 1 of a fairly parallelpiped shape, the upper part of which has a bridge 2, which in its middle has a raised thickness provided with an orifice at its highest point. The lower face of the bridge adopts a dentate configuration 3, based on protrusions and intrusions, of an equal number plus one with respect to the number of positions provided for the switch.

Into the orifice of the bridge part 2 there is inserted a shaft 4 joining a control or operating lever 5 with the aforementioned support 1 by means of a fork-shaped part 6 appropriately joined to the lever 5, and having ends with extended notches 7.

Inside the support part 1, there is a pin-bearing part 8 introduced by means of slippage in ribs 9, 9' provided on the laterial faces of the support part 1, with which the pin-bearing part 8 is held in place.

The aforementioned part 8 has some aligned housings 10 in an area slightly off its median line, which housings 10 have a necking on their upper part and on which will be housed the pins 11 with a stepped configuration to act as a stop at the aforementioned necking.

Figure 4:
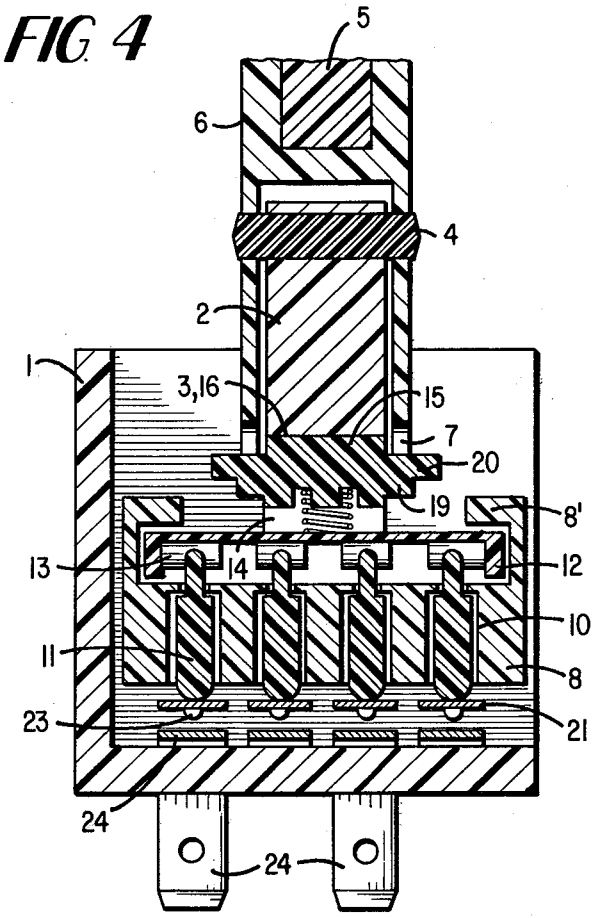
FIG. 4 is a cross-section view along the line IV—IV of FIG. 1.
Figure 3:
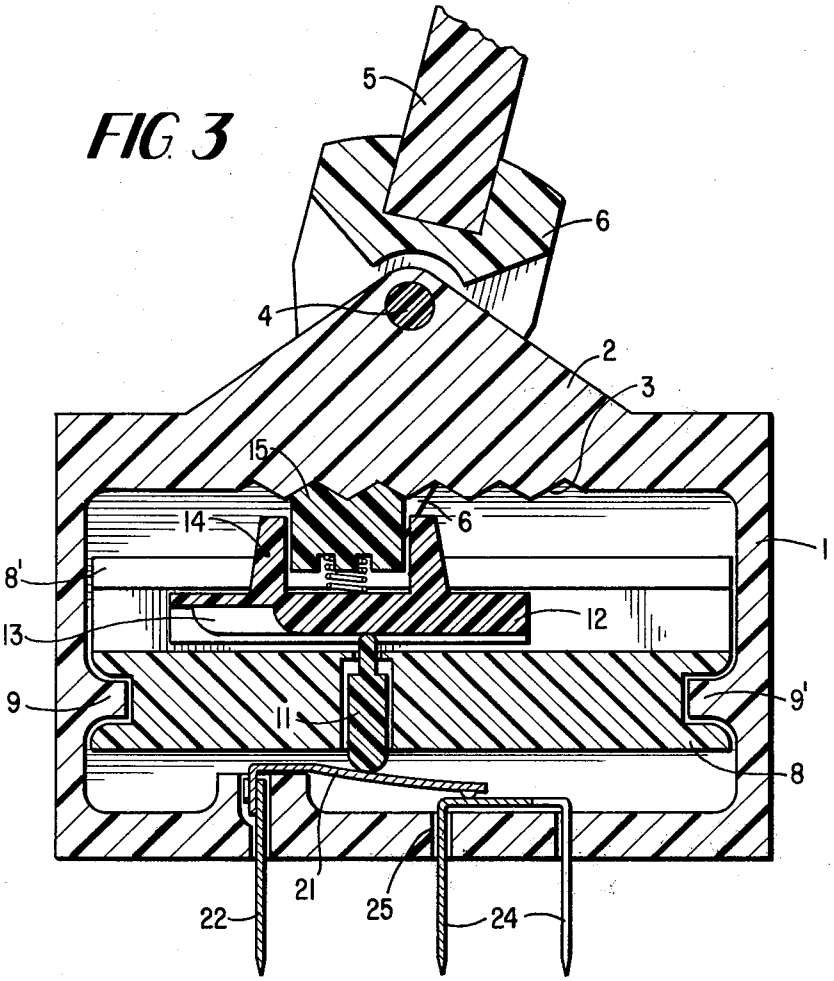

The part 8 also has, on its upper part and along the edges of its largest sides, some projections 8' in an inverted "L" (FIG. 4), forming channel paths in which a cam-bearing part 12 is held in place and can move longitudinally.

This cam-bearing part 12 has, on its underside, some cams or ribs 13 of a distinct length, the cams or ribs 13 having operating end advantageously shaped or rounded for better thrust of the pins 11. On its top side, the part 12 has two spaced vertical projections 14 whose purpose is to receive a crown part 15, by means of which the longitudinal slippage movements will be conveyed to the cam-bearing part 12

The part 15, called a crown, has on its upper face a dentate surface 16 with a configuration equivalent to that of the area 3 of the bridge 2. The number of teeth 16 is limited to two in order to fix a recess to receive successively one of the projections 3 of the bridge 2, producing a retention of the slippage of the cam-bearing part 12 corresponding to each of the contact positions provided for the switch.

On its lower face, the crown 15 has a collar hole 17 in which is housed a spring 18 which, supported by the top face of the cam-bearing part 12 between the projections 14, pushes this crown 15 upwards so that there is always contact between the dentate areas 3 and 16.

In addition, the crown 15 has on its lateral faces some cylindrical projections 19 equipped at their ends with stops 20, with the notches 7 of the fork 6 joined to the lever 5 causing the cylindrical projections 19 with no risk of their slipping out laterally since the aforementioned stops 20 are longer than the width of the notches 7.

The unit is completed with contact plate clips 21 joined to terminals 22, each contact plate clip 21 being equipped with a contact point 23. These contact plate clips 21 are held in place on the lower part of the chassis 1 by housing between two transversal ribs in the latter.

At an appropriate distance from the contact plate clips 21 and a front of the contact points 23, there are located terminals 24 which have a flexed shape and which are inserted through equivalently sized holes 25 on the lower face of the support.

With the unit thus arranged, a clockwise movement of the lever 5 (as represented) will, by making forked end 6 pivot on the axis 4, force a movement of the crown part 15 toward the left, which in turn will pull the cam-bearing part 12 in this same direction by reason of the inclusion of this crown 15 among the projections 14 of the aforementioned part 12. When it moves, the crown 15 descends slightly because its dentate surface 16 is in contact with the dentate surface 3 of the bridge 2, forcing compression of the spring 18 and causing retention as soon as the intermediate recess of the crown 15 has reached the following tooth of the area 3. This movement between teeth will have been sufficient for the part 12, thus pulled along, to have made one of its cam 13 enter into contact with one of the pins 16, causing the latter to descend, flexing the corresponding contact plate 21 and closing the desired circuit by means of the contact between the contact point 23 and its associated terminal 24. By again moving the lever 5 clockwise by a little, a new movement between teeth is caused, and now a second cam 13 causes another pin 11 to move downward to likewise close a new circuit.

With the lever 5 moved to its final clockwise sweep, all the cams 13 will keep the pins 11 pushed downward, whereby all the circuits planned to be activated with this switch will be closed or activated. Obviously, the step-by-step or complete anti-clockwise movement of the lever 5 will open the respective circuits one by one until they have all been opened, since the flexibility of the material of the plates 21 will make it possible for the pins 11 to return to their highest or resting position as soon as the action upon them of the corresponding cams ceases.

In the example shown in the accompanying drawings, the number of cams and therefore of pins, and the number of circuits to be activated by means of the switch, have been limited to four. However, the switch could obviously be equipped with a greater number of cams, and therefore of pins, thereby giving it a greater capacity with respect to circuits to be activated.

Likewise, it is necessary to underscore the possibility of giving the cams 13 a length distinct from the progressively staggered one shown in the attached figures. It would also be possible to subdivide each one into one or more cams in order to obtain a distinct actuation for the circuits shown in the example, wherein the end positions of the lever 5 require that all the circuits be opened or closed. It then would be possible for each one of the positions to be adopted by the aforementioned lever so as to correspond to the simultaneous opening or closing of two or more circuits, depending on whether this had been provided for in the designing of said cams.

In the example shown, the terminals 24 appear arranged alternately for better determination of the cams to which they correspond, or of the order of actuating their respective circuits, it being obvious that they could be aligned or placed in any other arrangement deemed appropriate.

Finally, the multiple switch unit shown will be completed by means of a cover of appropriate dimensions to be placed over the face of the support 1, through which cover the various component parts are introduced, and another closing cover can be provided above to carry some attachment bushings for the device.

The above embodiments are provided by way of example, and it is understood that the scope of the present invention is limited only by the appended claims.

I claim:

1. A selective multiple switch comprising:

a substantially parallelpiped shaped support, hollowed out inside, which on its upper face has a lengthwise bridge having a lower surface which has a dentate configuration formed by recesses and protrusions;

an operating lever ending in a fork shape capable of pivoting on an axis located in a hole provided in the aforementioned bridge at a mid-point on the side opposite the dentate configuration;

a pin-bearing part that is housed and held in place inside the support toward its lower middle zone, and which has, approximately in its middle and transversely aligned, a plurality of bushing holes for receiving an equal plurality of pins;

a cam-bearing part capable of being held in place in said pin-bearing part and sliding longitudinally with respect to said pin-bearing part, said cam-bearing part having a lower face which has a plurality of parallel rib-like cams arranged lengthwise and with distinct predetermined dimensions, and having an upper face having spaced vertical projections;

a crown-shaped portion, having in cross-section a crown-like shape, housed between the vertical projections provided on the upper face of the aforementioned cam-bearing part, and having a dentate face adjacent to the dentate configuration of said lower surface of said lengthwise bridge of said support, said crown-shaped portion having, on a face opposite the dentate face, a collar hole for receiving a spring to maintain the dentate face of said crown-shaped port in contact with the dentate configuration of the lower surface of the lengthwise bridge of the support;

a plurality of flexible contact plates having respective ends provided with contact points and set on a lower face of the support, each of the contact plates being located facing a corresponding one of the pins provided in the bushing holes of the pin-bearing part; and a plurality of terminals connected to distinct electrical circuits, and also located on the lower face of the support, each terminal facing a corresponding one of the contact points provided on the flexible contact plates.

2. The selective multiple switch according to claim 1, wherein the operating lever is joined to the crown-shaped portion so that angular displacements of said operating lever cause longitudinal sliding of the crown-shaped portion, overcoming the action of the spring, the dentate configuration of the lower surface of the support and the dentate face of the crown-shaped portion being in permanent contact and serving to determine retention positions of movement of the crown-shaped portion in such a way that said sliding of the crown-shaped portion causes an identical movement of the cam-bearing parts so that the parallel rib-like cams successively push and move downward the pins of the pin-bearing part, the pins flexing the flexible contact plates until they touch the terminals and thus close the distinct electrical circuits connected thereto; and wherein movement in the oppposite direction of the operating lever causes a movement also in the opposite direction of the cam-bearing part, so that the pins are returned to their resting position by the restoration of the flexible contact plates, thus opening the distinct electrical circuits.

3. The selective multiple switch according to claim 1, wherein the dentate face of the crown-shaped portion comprises a double dentation defining a corresponding recess in a mid point thereof, and wherein, upon receiving each of the protrusions of the lower face of the bridge of the support, the corresponding recess marks the retentions or distinct positions in the sweep of the operating lever, each of these successive positions affecting the action of a respective pin on its corresponding flexible contact plate and terminal.

4. The selective multiple switch according to claim 1, wherein the rib-like cams have distinct lengths with respect to each other, said distinct lengths each being sufficient for each advance of the crown-shaped portion over the dentate configuration of the bridge of the support to correspond to the action of a respective cam on a corresponding pin.

5. The selective multiple switch according to claim 4, wherein each of the cams may have breaches of continuity so that, in its full sweep, each cam can activate a single pin at least two times.

* * * * *